US006988815B1

(12) United States Patent
Rizkin et al.

(10) Patent No.: US 6,988,815 B1
(45) Date of Patent: Jan. 24, 2006

(54) MULTIPLE SOURCE COLLIMATED BEAM LUMINAIRE

(75) Inventors: Alexander Rizkin, Redondo Beach, CA (US); Il'ya Agurok, Huntington Beach, CA (US); Robert H. Tudhope, Rancho Palos Verdes, CA (US)

(73) Assignee: Farlight LLC, Wilmington, CA (US)

( * ) Notice: Subject to any disclaimer, the term of this patent is extended or adjusted under 35 U.S.C. 154(b) by 64 days.

(21) Appl. No.: 09/867,881

(22) Filed: May 30, 2001

(51) Int. Cl.
*F21V 9/06* (2006.01)

(52) U.S. Cl. ..... 362/245; 362/328

(58) Field of Classification Search ..... 362/231, 362/494, 800, 242–247, 308, 309
See application file for complete search history.

(56) References Cited

U.S. PATENT DOCUMENTS 4,678,269 A * 7/1987 Pace ..... 250/227.24
4,915,484 A 4/1990 Yamamoto
5,136,483 A 8/1992 Schöniger et al.
5,321,717 A 6/1994 Adachi et al.
5,467,335 A 11/1995 Braat
5,553,174 A 9/1996 Snyder
5,592,578 A * 1/1997 Ruh ..... 385/31
5,621,829 A * 4/1997 Ford ..... 385/115
5,854,872 A 12/1998 Tai
6,075,650 A 6/2000 Morris et al.
6,132,072 A 10/2000 Turnbull et al.
6,334,699 B1 * 1/2002 Gladnick ..... 362/268

* cited by examiner

*Primary Examiner*—Sandra O'Shea
*Assistant Examiner*—John Amarantides
(74) *Attorney, Agent, or Firm*—Gehrke & Associates, S.C.; Lisa A. Brzycki

(57) ABSTRACT

A luminaire comprising a light transmissive optical element, a plurality of light sources, a light source support structure, and a light reflective surface. The light transmissive optical element, which preferably is a quasi-toroidal light transforming collector, is spaced from and disposed about an axis. The plural light sources are disposed radially outwardly of the optical element relative to the axis, to produce a corresponding plurality of light beams. Each light source directs its light beam toward the optical element. The optical element is shaped and adapted to collect and transform the light beams and pass them in the direction of the axis. The light reflective surface, which preferably is a curved conical collimating combiner, is spaced from the optical element, and is disposed along the axis. The light reflective surface is optically shaped to redirect along the axis and combine the plurality of light beams passed by the optical element to produce a collimated beam of light from the re-directed plurality of light beams.

13 Claims, 6 Drawing Sheets

MULTIPLE SOURCE COLLIMATED BEAM LUMINAIRE

TECHNICAL FIELD

The present invention, in general, is directed to a multiple source lighting device. The invention, more particularly, is directed to a luminaire that produces a collimated beam of light from a plurality of sources spaced about the collimator.

BACKGROUND OF THE INVENTION

It is well known that in many practical applications it is desirable to combine light from multiple light sources into one single beam. Of special interest is application of semiconductor-based light sources, such as laser diodes and light emitting diodes (LEDs). Even with recent progress in semiconductor technologies and advances toward more powerful LED designs, many applications still require the combined light output from a plurality of sources to achieve desirable luminous flux and/or color combinations. The dominant state-of-the-art solution is based on the use of an array of multiple individual peripheral optical elements described, for example, in U.S. Pat. Nos. 5,369,659 and 5,592,578. Unfortunately, these devices are expensive, bulky, cumbersome, require fine optical tuning and correction, and are not suitable for mass production.

Accordingly it would be desirable to have a luminaire which uses multiple light sources but produces an output beam collimated by a single set of optics, and which is compact and inexpensive.

OBJECTS AND SUMMARY OF THE INVENTION

It is therefore a principal object of the present invention to provide a luminaire which produces a single collimated beam from multiple light sources using a single set of optics and which is also compact, simple to operate, and electrically efficient.

To achieve extended useful life at reduced operating expense, yet another object of the present invention is to provide a luminaire of unique design, into which multiple commercially-available LEDs, even those emitting highly divergent beams, may be incorporated, for producing a collimated output light beam.

It is another object of the present invention to provide a luminaire in which multiple controlled intensity red, green, and blue LEDs are used for producing a collimated color-controlled beam using a single set of optics.

Yet another object of the present invention is to provide a luminaire design which incorporates thermoelectric elements for LED temperature control and, as a result, luminaire photometric performance stabilization.

Yet another object of the present invention is to provide a luminaire design with predetermined luminous intensity distribution across the collimated beam, and specifically in a preferred embodiment, with equal luminous intensity distribution across the collimated beam.

These and other objects will become readily apparent to those skilled in the art following brief review of the present invention, which shall now be summarized.

The present luminaire comprises a light transmissive optical element, a plurality of light sources, a light source support structure, and a reflector. The light transmissive optical element is spaced from and disposed about an axis.

The plurality of light sources is disposed radially outwardly of the optical element relative to the axis, on the light source support structure, for producing a corresponding plurality of light beams. "Beam" herein means a bundle of light rays which can be described as having light source spatial luminous intensity distribution. Each light source directs its corresponding light beam toward the optical element. The especially shaped optical element collects, transforms, and passes in the direction of the axis the plurality of light beams. The reflector, spaced from the optical element, is disposed along the axis. The reflector, moreover, is especially optically shaped to redirect the individual light beams and combine them into a single collimated beam. The reflector of the present invention is designed to achieve this and other purposes, as will become readily apparent to those skilled in the art after reviewing this patent specification and the associated drawings.

In a preferred embodiment of the luminaire of the invention, the optical element is generally quasi-toroidal in shape and is formed by rotating a closed-curved non-circular section about the axis. It collects and transforms the plurality of light beams. The reflector is generally conical in shape and is formed by rotating a generally triangular section having a curved hypotenuse about the axis. It redirects and combines the light from the optical element into a single collimated beam.

In an especially preferred embodiment of the luminaire of the present invention, the optical element is a quasi-toroidal light transforming collector comprising an assembly of concentric components having different indices of refraction, the reflector is a curved conical collimating combiner, each one of the plurality of light sources is a light emitting diode, and a support structure is designed as a heat sink.

Yet in another especially preferred embodiment of the luminaire of the present invention, the optical element is a quasi-toroidal light transforming collector, the reflector is a curved conical collimating combiner, each one of the plurality of light sources is a combination of red, green and blue light emitting diodes with electrically controlled intensity of emitted light.

Yet in another especially preferred embodiment of the luminaire of the present invention, the optical element is a quasi-toroidal light transforming collector, and the reflector is a curved conical collimating combiner, each one of the plurality of light sources is a light emitting diode incorporated into a supporting structure having a thermoelectric cooling element, and the support structure is designed as a heat sink.

Yet in another especially preferred embodiment of the luminaire of the present invention the optical element is a quasi-toroidal light transforming collector, and the reflector is a curved conical collimating combiner designed to provide a predetermined luminous intensity distribution across an outgoing collimated beam.

These and other features and advantages of the invention will be apparent to those skilled in the art, after referring to the following description and accompanying drawings.

BRIEF DESCRIPTION OF THE DRAWINGS

A clear understanding of the various advantages and features of the present invention, as well as the construction and operation of conventional components and mechanisms associated with the present invention, will become more readily apparent by referring to the exemplary, and therefore non-limiting, embodiments illustrated in the following drawings which accompany and form a part of this patent specification.

Throughout the drawings, like reference numerals refer to like parts.

DETAILED DESCRIPTION OF PREFERRED EMBODIMENTS

Figure 1:
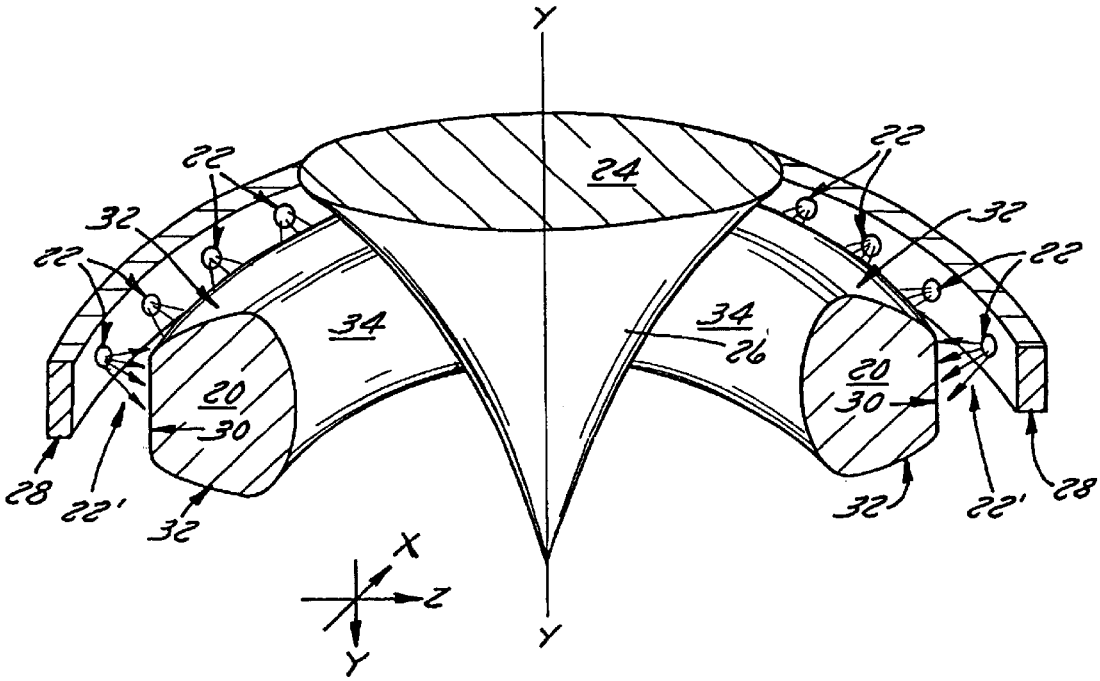
FIG. 1 is a perspective view, partially in section, of a first embodiment of the invention.
Figure 2:
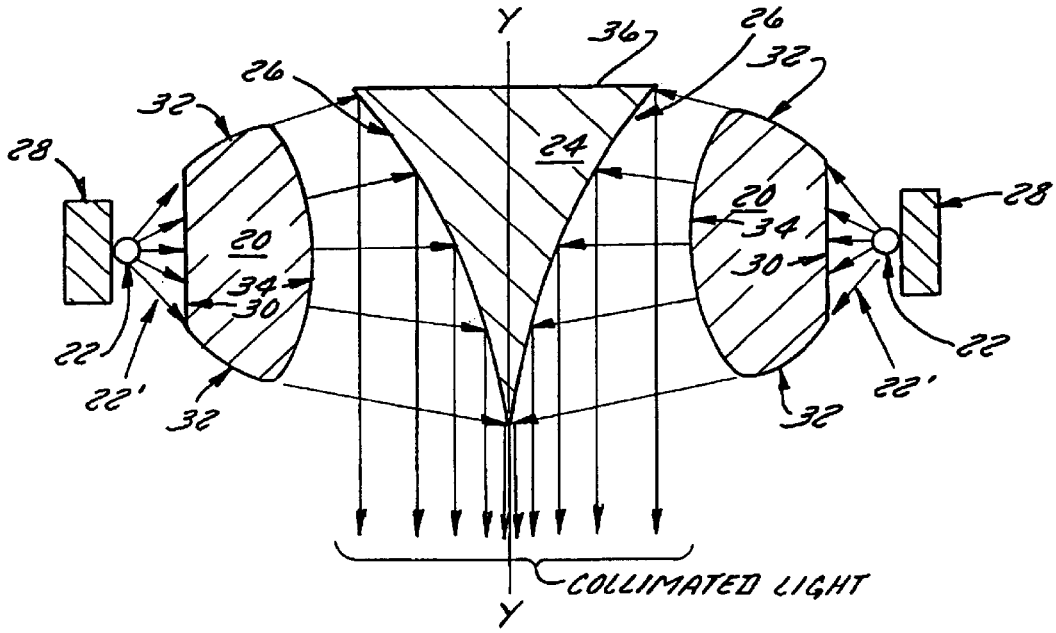
FIG. 2 is a side view, in section, of a first embodiment of the invention.
Figure 3:
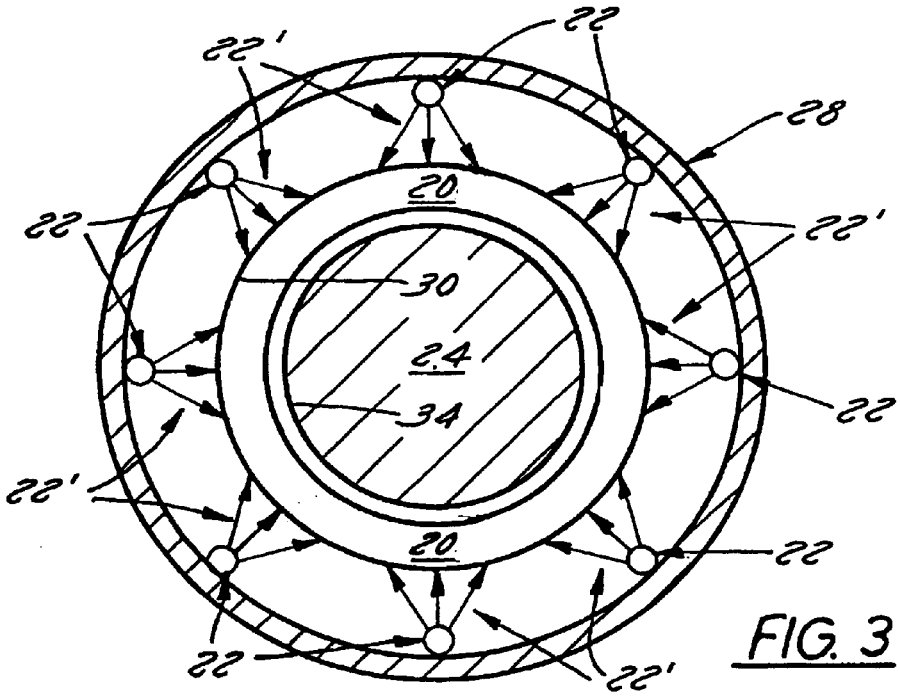
FIG. 3 is a plan view of the first embodiment of the present invention.

Referring initially to FIGS. 1, 2 and 3, the present invention comprises a light transmissive optical element 20, a plurality of conventional light sources 22, a light beam reflector 24 defining a light reflective surface 26, and a light source support structure 28. The optical element 20 is made of a suitable commercially available clear, transparent and highly light transmissive material and is spaced from and disposed about an axis, Y—Y.

The plural light sources 22 are disposed radially outwardly of the optical element 20 relative to the axis Y—Y, and on light source support structure 28 to each produce a corresponding plurality of light beams 22' (the several rays shown emanating from each source 22 may be thought of as one "beam"). As is shown in FIG. 3, the plurality of light sources 22 are preferably equally peripherally spaced and radially outwardly of the optical element 20 relative to the axis Y—Y (FIGS. 1 and 3). Non-equally spaced light sources may be used as well. Still further, the plural light sources 22 are all preferably located on the light source support structure 28, in the same plane, which plane is preferably disposed orthogonal to the axis Y—Y. Those skilled in the art, after reviewing this patent specification and the accompanying drawings, will readily be able to select an optimal number of light sources, and spacing between them, to achieve a desired effect. In this regard, each light source 22 directs a corresponding one of the plural light beams 22' toward the optical element 20. The optical element 20 is especially optically shaped and configured to collect, transform, and pass in the direction of the axis Y—Y, the plural light beams 22' received from the plurality of light sources 22.

For this purpose, the optical element 20 includes a light receiving surface 30 that is highly light transmissive, wherein the light receiving surface 30 is designed so that substantially all incident light from the sources 22 is able to pass into the optical element 20. Moreover, to direct virtually all such light passing into the optical element 20 toward the direction of the axis Y—Y, the optical element 20 further includes light directing surfaces 32, which may be coated (internally or externally) with a suitable commercially-available light reflective substance or which may cause the light within element 20 to undergo total internal reflection (TIR) so that substantially all of the light beams 22' from the plural sources 22 collected by the optical element 20 are directed toward the axis Y—Y.

Still further in this regard, the optical element 20 includes a light output surface 34 characterized as clear, transparent and highly light transmissive and which may be especially shaped and designed so that light output from the optical element 20 and reflecting off the light reflective surface 26 forms a collimated beam of light, as shown in FIG. 2. The illustrative light output surface 34 may be any number of shapes satisfying the teachings herein.

The light reflective surface 26 is spaced from the optical element 20 and is disposed generally along the axis Y—Y, as shown in FIG. 2. The light reflective surface 26 is preferably conically shaped to achieve certain light redirecting, combining, and collimating purposes. The first purpose is to redirect the plural light beams 22' passed by the optical element 20 so that they are parallel to the axis Y—Y (essentially 90° relative to the original direction of the plural light beams exiting optical element 20). Another purpose is to combine and collimate the plurality of redirected light beams along the axis Y—Y. These and other purposes of the light reflective surface 26 disclosed and described herein will become readily apparent to those skilled in the art after reviewing this patent specification and associated drawings.

Further in this regard, in order to re-direct and collimate the light, whenever the present invention is incorporated, for example, into such conventional structures as navigation lights, traffic signal housings and so forth, the optical shape of the light reflective surface 26 will generally be relative to the optical shape of light directing surface 32 and of the light output surface 34 of the optical element 20, to achieve a desired collimated light beam output. For example, referring to FIG. 1, those skilled in the art know that the light beam reflector 24 may be formed by revolving a two-dimensional, generally triangular section 36 on the axis Y—Y to achieve a generally conical shape as shown.

Note that the curved surface of light reflective surface 26 is smoothly curved, not faceted. Note further that the illustrative triangular shape 36 presents preferably concave surface 26 along the curved hypotenuse of the triangular shape 36. Thus, the light reflective surface 26 is formed by rotating the generally triangular section 36 with a curved hypotenuse on the axis Y—Y, to achieve a curved conical member having these properties.

Thus, aspects or features of the optical element 20 (FIGS. 1 and 2) include (1) the light receiving surface 30, which is disposed in proximal relation to associated light sources 22; and which is oriented to receive and collect the maximum quantity of light from the associated light sources 22; (2) the light output surface 34, which is disposed in distal relation to the associated light sources 22, and which is oriented relative to an axis Y—Y to output from the light transmissive optical element 20 the maximum quantity of light received via the light receiving surface 30 from the associated light sources 22; and (3) the light directing surface 32, disposed between the light receiving surface 30 and the light output surface 34 for passing the maximum quantity of light received via the light receiving surface 30 from the associated light sources 22 to the light output surface 34.

In operation, optical element 20 collects light from a plurality of light sources 22 (FIGS. 1 and 2), to transform the light beams radially inwardly toward the axis Y—Y about which the light beam reflector 24 is disposed. The light reflective surface 26 of reflector 24 in turn changes the direction of the radially inwardly directed light beams, causing the beams to combine and be redirected into a single collimated beam along axis Y—Y, which direction is disposed transverse (preferably 90°) relative to the original, radially-inward direction of the light beams. Thus, the light transmissive optical element 20 (FIGS. 1, 2 and 3) is designed to collect light from the plural light sources 22 and output it toward the light reflective surface 26 of light beam reflector 24 to achieve a single collimated beam from multiple light sources in a compact design.

As is shown in FIGS. 1, 2 and 3 the optical element 20 is preferably generally quasi-toroidal in shape and is formed by rotating the above-described closed-curved surfaces 30, 32 and 34 (FIGS. 1 and 2) about the axis Y—Y. The term "quasi-toroid" as used herein shall be understood to refer to any generally smoothly-curved surface generated by rotating a closed curved surface in a plane and about an axis, in contrast with term "toroid," which is a surface generated by rotating a circular curved surface in a plane and about an axis.

Figure 4:
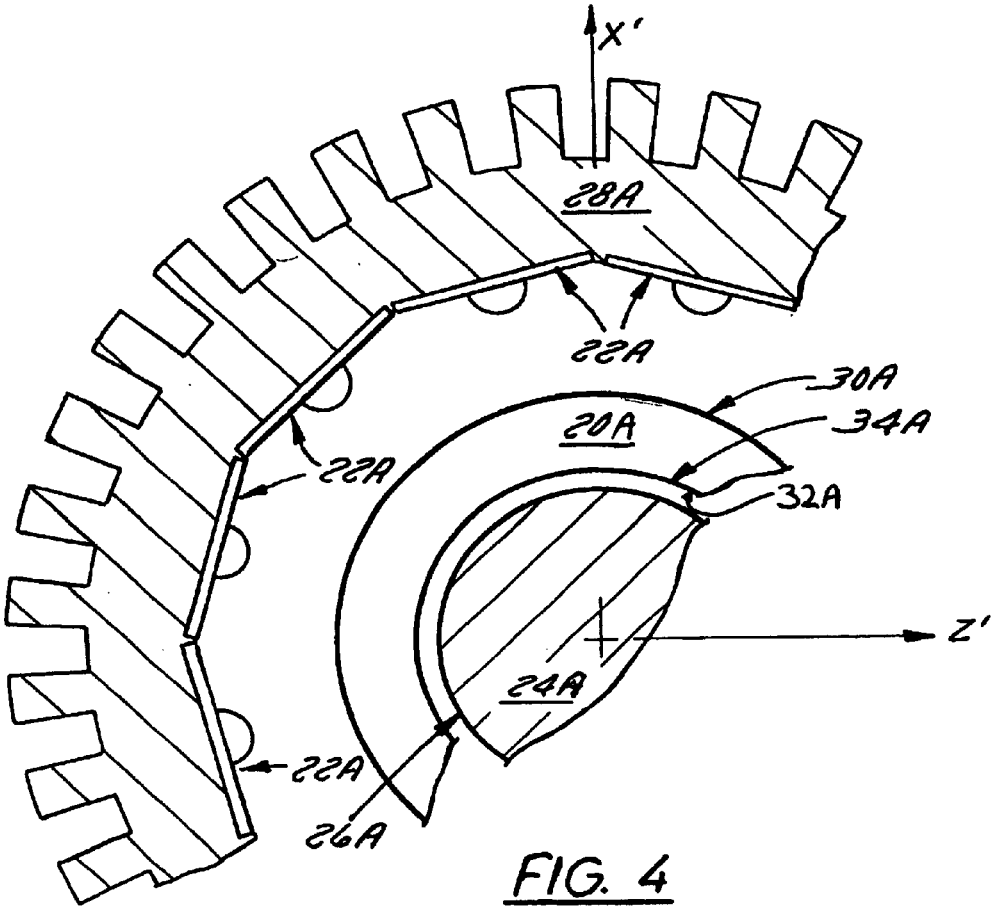
FIG. 4 is a plan view of an embodiment of the invention having light emitting diodes.

Reference is now made to FIG. 4, a plan view (in X'–Z' coordinates) of another embodiment of the present invention. In FIG. 4, the luminaire is presented partially in section to further illustrate the generally quasi-toroidal shape of the optical element 20A, which is preferably a quasi-toroidal light transforming collector, as well as to illustrate the peripheral spacing of the light sources 22A relative to each other and from the optical element 20A. Further in this regard, FIG. 4 depicts the radial spacing of the optical element 20A, relative to the light beam reflector 24A and its associated light reflective surface 26A, which is preferably a curved conical collimating combiner. Also note that the light reflective surface 26A is a closed, smoothly curved surface continuous along axis Y—Y, to present a collimated light beam along axis Y—Y.

In the embodiment presented in FIG. 4, when the light sources 22A are LEDs, any number of LEDs may be equally peripherally spaced radially outwardly of the optical element 20A relative to the axis Y—Y. The output of these multiple light sources is transformed and combined into a single collimated beam such as for a relatively high-intensity spotlight or a traffic light or any number of other uses.

Figure 4A:
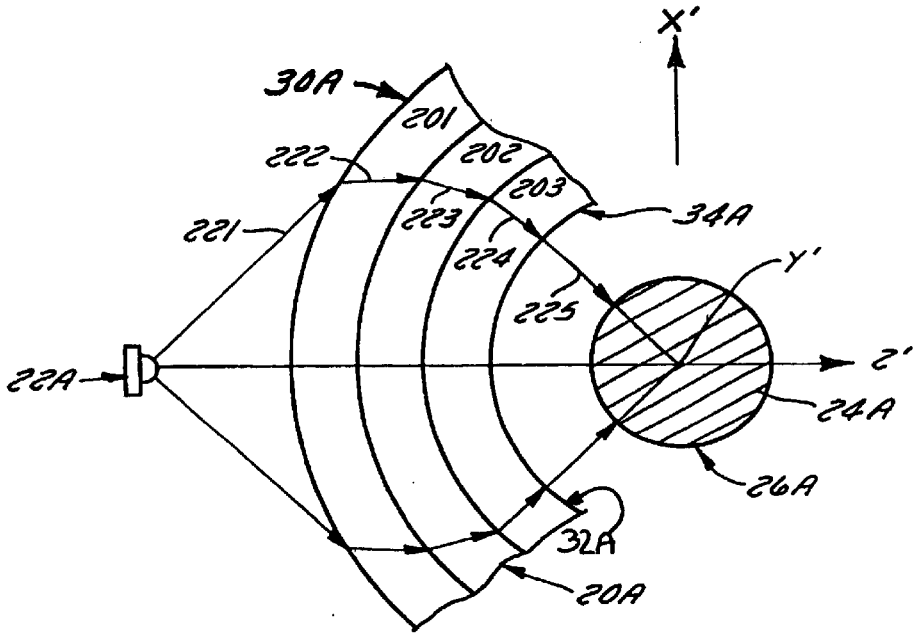
FIG. 4A is a partial plan view of an embodiment of the invention with a quasi-toroidal light transforming collector comprising an assembly of components.

It is well known that, in general, LEDs emit a highly divergent beam. The quasi-toroidal light transforming collector 20A is therefore designed to compensate for this divergency and to transform light output from the LEDs into a more usable spatial distribution prior to being reflected by curved conical collimating combiner 24A. Further in this regard, FIG. 4A shows another embodiment of the present invention in which the quasi-toroidal light transforming collector 20A comprises a number of concentric quasi-toroidal components 201, 202 and 203 fabricated from material with different indices of refraction. Each component in this embodiment is disposed close to the axis Y'—Y' and has an index of refraction higher than the adjacent one. Specifically, external component 201 has the lowest index of refraction and internal component 203 has the highest index of refraction of these components. Those skilled in the art of optics will understand that each component will operate as a cylindrical lens having high optical power in the horizontal plane X'–Z' and very little optical power in the vertical plane X'–Z' (or Z'–Y'). As a result, a highly divergent ray 221 emitted by light emitting diode 22A and directed to the receiving surface 30A, is diffracted consecutively in the direction of 222, 223 and 224, and leaves output surface 34A in direction 225, perpendicular to the vertical axis Y'—Y' of the curved conical collimating combiner 24A. Note also that quasi-toroidal light transforming collector 20A includes associated light directing surfaces 32A and associated output surface 34A, which are geometrically and structurally different from the first embodiment.

It is also known, that in general LEDs generate heat. Further in that regard, LED performance and longevity is thus dependent upon the removal of such LED-generated heat and therefore, the luminaire of the second embodiment preferably includes an effective amount of heat-transfer surface area. In this regard, the light source support structure 28A (FIG. 4) may be made of a suitable durable heat-transmissive material such as stainless steel or aluminum, which has sufficient mass and surface area to provide satisfactory "heat-sink" properties, as may be desired.

Figure 5:
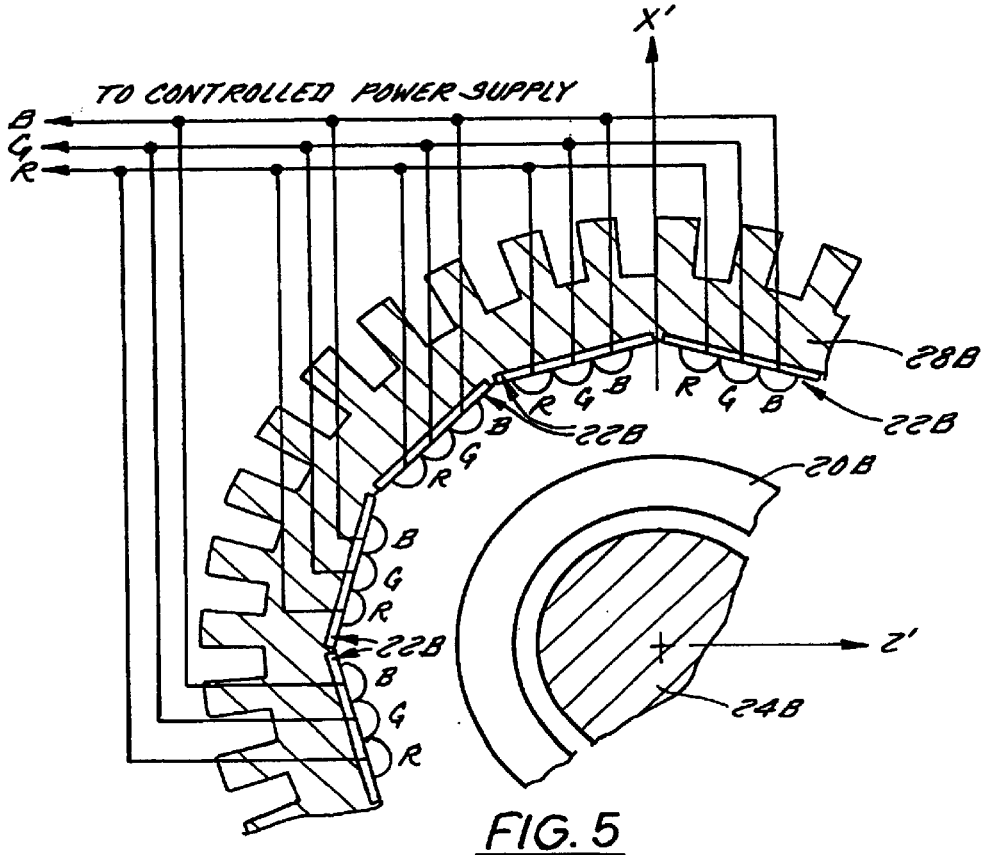
FIG. 5 is a plan view of an embodiment of the invention with a combination of red, green, and blue light emitting diodes with electrically controlled intensity.

Next referring to FIG. 5, another embodiment of the present invention is shown to comprise a quasi-toroidal light transforming collector 20B, a curved conical collimating combiner 24B, a light source support structure 28B, and a plurality of light sources 22B, each light source comprising a combination of red, green, and blue light emitting diodes connected to an R, G, B-controlled power supply. As is seen, there are a number of light sources equally peripherally spaced radially outwardly of the quasi-toroidal light transforming collector 20B relative to the axis Y—Y orthogonal to plane X'–Z'. All light emitting diodes are installed on the support structure 28B in plane X'—Z' in such a manner that the light patterns from the red, green, and blue LEDs corresponding to the same light source are overlapped. The combined colored light of these multiple light sources is transformed and combined into a single collimated beam, which will have any desired color, depending on the combined intensities of red, green and blue LED's, selected from controller power supply.

Figure 6A:
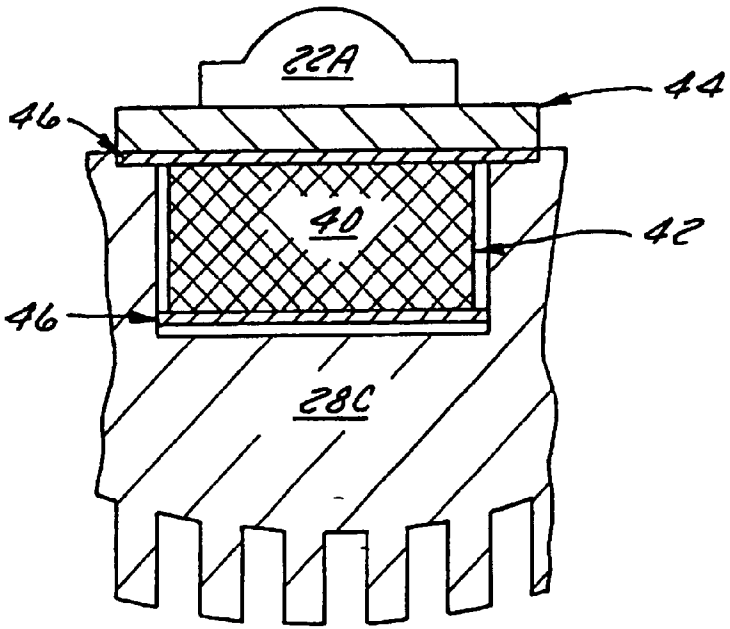
FIGS. 6 and 6A are plan views of yet another embodiment of the invention having a thermoelectric cooler and a support structure heat sink.
Figure 6:
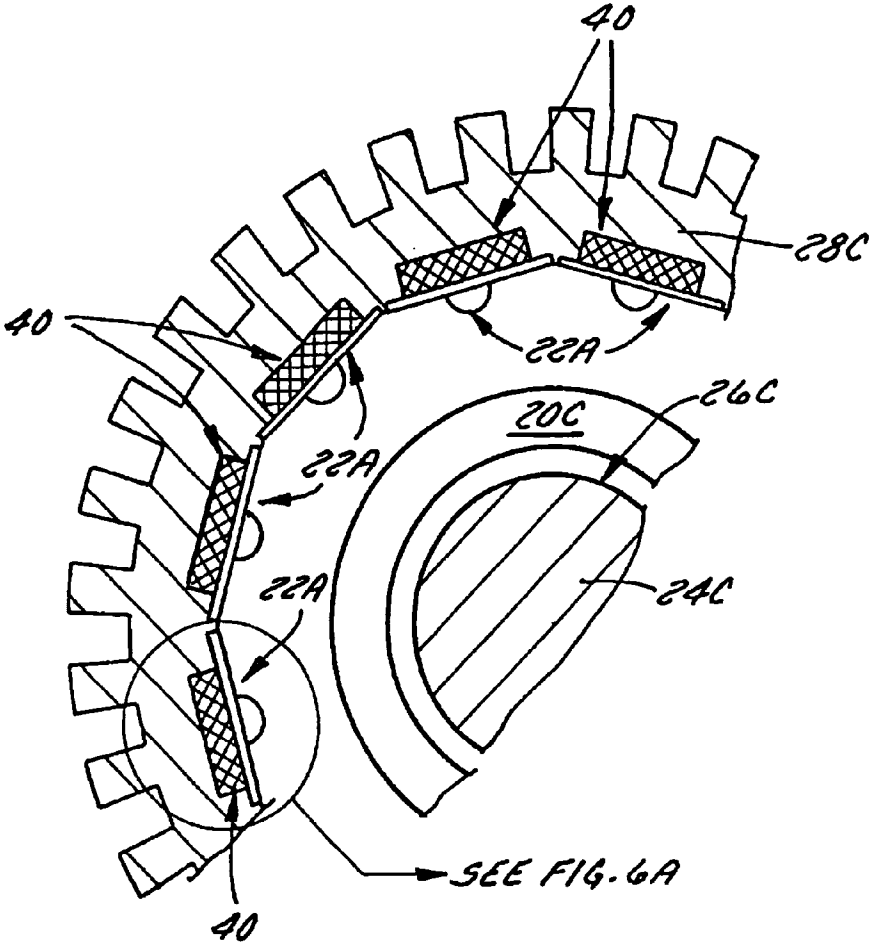

Next referring to FIGS. 6 and 6A, still another embodiment of the present invention is shown to include yet another embodiment of the curved conical collimating combiner 24C having a light reflective surface 26C, yet another embodiment of the quasi-toroidal light transforming collector 20C radially spaced from and disposed about the curved conical collimating combiner 24C, and a plurality of LEDs 22A equally radially spaced outwardly of the optical element 20C and the light beam reflector 24C, and equally peripherally spaced about the optical element 20C.

The plurality of LEDs 22A are installed on light source support structure 28C which is designed as a heat-sink having an effective amount of heat-transfer surface area to remove heat generated by the LEDs.

It is well known that LED longevity and performance (generated light flux, color and spatial light distribution) is highly dependent on ambient temperature. Specifically, LED performance decreases as temperature rises. In accordance with another principle of the present invention, to stabilize LED performance over a wide temperature range (i.e., enabling the LED to operate with specified performance in extreme climates and weather conditions), the luminaire of the embodiment preferably includes a temperature-control device 40, such as the thermoelectric module shown in FIGS. 6 and 6A. These thermoelectric modules may be semiconductor Peltier devices. The modules act as heat pumps which transfer heat by electric current. A principal utility of the thermoelectric modules is in the cooling of heat-generating microcircuits.

Further in reference to the present embodiment, the illustrated temperature-control device 40 is disposed within the cavity 42 of light source support structure 28C in association with a heat-transfer base 44, which may be a part of LED 22A. The temperature-control device 40 is operatively connected to a power supply by wires (not shown). Further in this regard, the temperature-control device 40 is spaced adjacent, preferably in surface-contacting association with, heat-transfer base 44 on one side and surface of cavity 42 on other side, by means of heat-transfer media 46 (such as glue or epoxy).

In operation, the temperature-control device 40 has a "cold" side surface contacting heat-transfer base 44 through heat-transfer media 46, and a "hot" side surface contacting lighting source support structure 28C, which is designed as a heat-sink, also through a heat-transfer media 46, disposed between temperature-control device 40 and the bottom of cavity 42. Therefore, the temperature of each LED will always be below ambient temperature, and heat generated by temperature-control device 40 will be removed through the heat-sink. Therefore, in accordance with another principle of the present invention, it is desirable for a heat-generating light source such as the LEDs 22A to operate across a wide temperature range with specified performance. Thus, based upon the performance characteristics of currently-available LEDs, it is estimated that a useful life of 100,000 hours even in extreme temperature conditions can be achieved.

Figure 7:
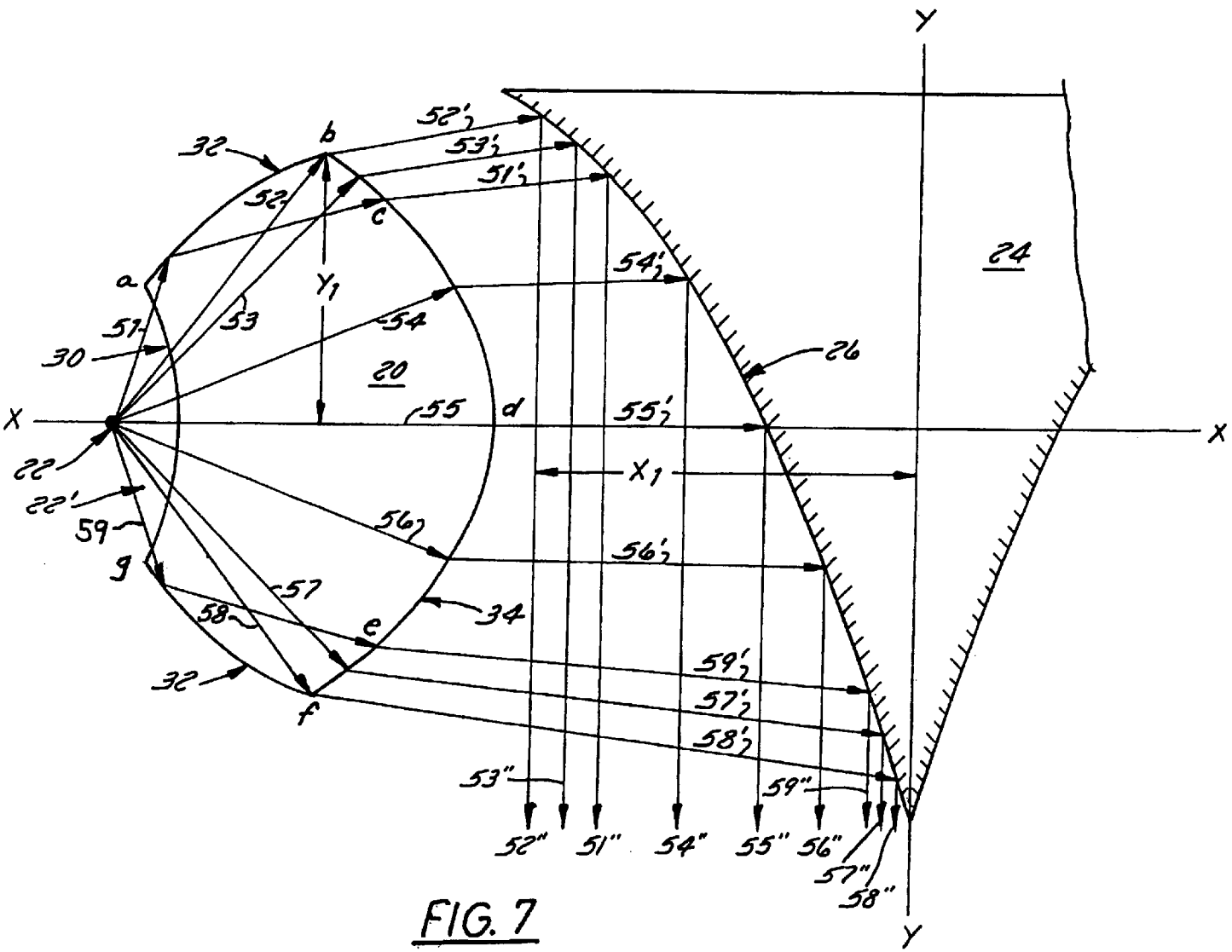
FIG. 7 is a side view, in section, of still another embodiment of the invention, depicting certain aspects or features of the invention, as viewed from the X-plane.
Figure 8A:
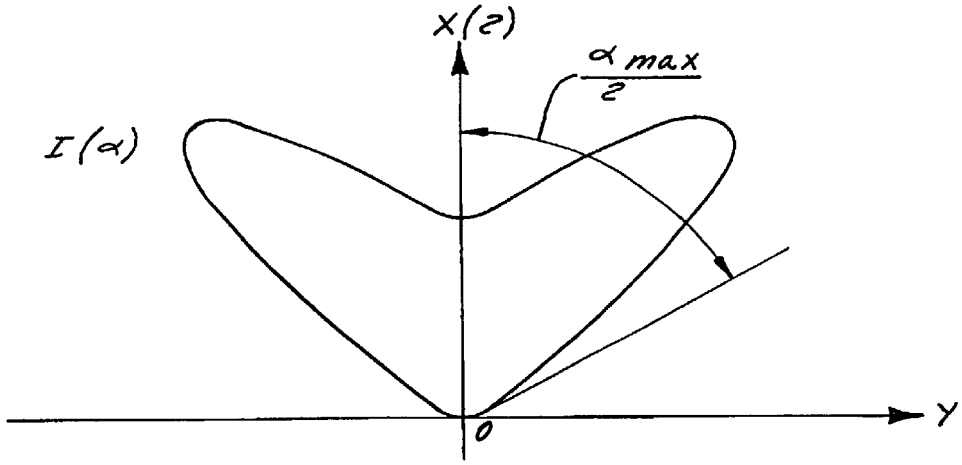
FIGS. 8 A, B, and C show graphic representations of spatial luminous intensity distributions (A) from an LED, (B) transformed by a quasi-toroidal light transforming collector, and (C) reflected by a curved conical collimating combiner.

Next referring to FIG. 7, certain aspects or features of another embodiment of the invention, as viewed from the X-Y plane, are shown. A quasi-toroidal light transforming collector 20 and a curved conical collimating combiner 24 can be designed and constructed as described below. The quasi-toroidal light transforming collector 20 includes a light receiving surface 30 (ag), light directing surface 32 (ab and fg), and a light output surface 34 (bcdef). The light source 22 directs a corresponding light beam 22' toward the optical element 20. This beam 22' can be described as a plurality of rays (51 to 59) which pass through transforming collector 20 differently depending on the angle of incidence and transforming collector 20 design. Assuming that the spatial luminous intensity distribution I(α) is symmetrical in plane X–Y with respect to axis X (see FIG. 8A), it will have identical performance for symmetrical rays (for example 53 and 57) in the "top" (abcd) and the "bottom" (defg). For simplicity the discussion below will be directed to the "top" area.

In general, there are two groups of rays: the first one is reflected from light directing surface 32 (ab), diffracted by transforming collector 20, and directed to conical combiner 24; the second one is diffracted and directly passed through light output surface 34 (bf). As an example, the first group of rays 51 and 52 will be reflected and diffracted in directions 51' and 52' respectively. The second group of rays 53, 54 and 55 will be diffracted in directions 53', 54' and 55' respectively. Note for future consideration that in area (bc) of light output surface 34 there are present both groups of rays directly diffracted from the light source and diffracted after reflection from area (ab).

As a result of reflection, diffraction and superposition of all the rays emitted by light source 22 and passing through quasi-toroidal light transforming collector 20, the spatial luminous intensity distribution of light source 22, I(α), will be transformed into the spatial luminous intensity distribution of transforming collector 20, I' (a', Y).

Figure 8B:
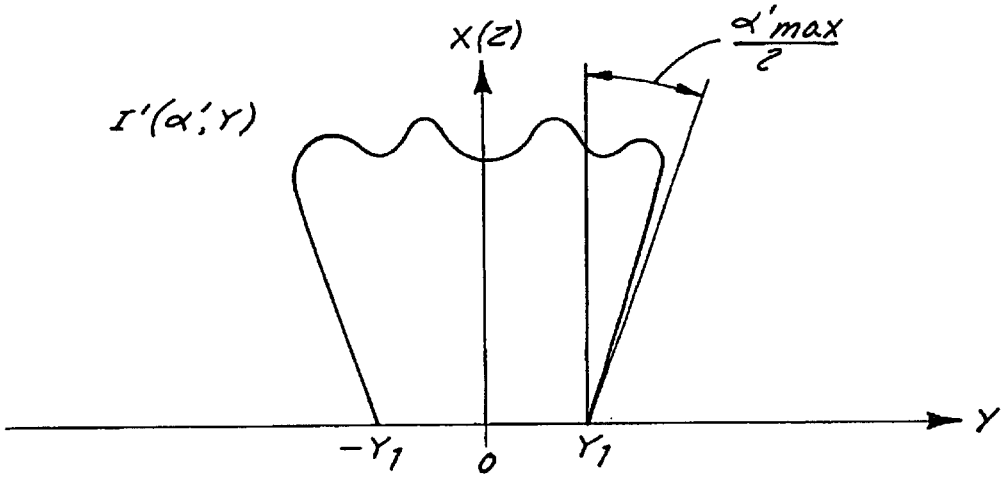

Referring now to FIG. 8B note the following:

The maximum angle $$\frac{\alpha_{\max}}{2}$$

of function I(α), which is the angle between ray 51 and ray 55 is now transformed into maximum angle $$\frac{\alpha_{\max}}{2}$$

of function I' (a', Y), which is the angle between ray 52' and ray 55', and angle $a'_{max}$ is essentially smaller than angle $\alpha_{max}$.

The geometrical characteristics of the transformed beam also have been changed from point source 22 emitting intensity I(α) to a circular area with radius Y, emitting intensity I' (α', Y). Coordinate Y corresponds to point (b) where light directing surface 32 is connected to light output surface 34 of quasi-toroidal light transforming collector 20.

As a result of redirection and redistribution of rays, the intensity distribution I' (α', Y) of light distributed from source 22 becomes more uniformly comparable with function I(α) and can be described as a variation ±A (α') around a constant value.

Those skilled in the art will understand that for a given luminous intensity distribution I(α) of light source 22, quasi-toroidal light transforming collector 20 can be designed in various ways. Specifically, the shapes of light receiving surface 30, light directing surface 32, and light output surface 34 can be calculated according to the desired luminous intensity distribution I' (α', Y).

Still referring to FIG. 7, note that the curved conical collimating combiner 24 is disposed generally along the axis Y—Y. The particular profile of curved conical surface 26 in each conical area must satisfy simultaneously two conditions:

1) It should redirect each ray of light passing through quasi-toroidal transforming collector 20 in a direction parallel to axis Y—Y, in other words it must collimate the outgoing beam;

2) It should combine all beams from the plurality of light sources into a single beam.

Figure 8C:
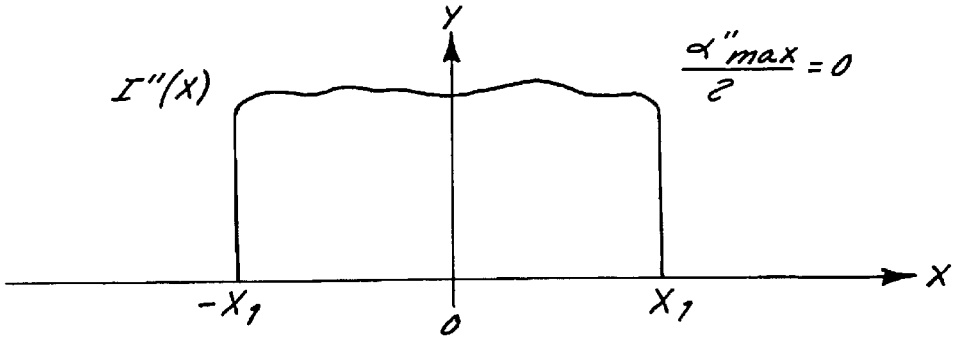

All rays (51' to 59') passed through quasi-toroidal light transforming collector are directed after reflection from the curved conical surface parallel to axis Y—Y, forming a collimated beam consisting of the plurality of rays 51" to 59". Each plurality of light sources 22 will form identical collimated beams, and the plurality of these beams will be integrated into one single collimated outgoing beam with luminous intensity distribution I" (X), as shown in FIG. 8C.

Because all outgoing rays are parallel to each other and directed along axis Y—Y, the divergency angle is equal to zero ($\alpha'_{max}$=0). The geometrical shape and size of the outgoing beam can now be described as circular in plane X–Z orthogonal to axis Y—Y with radius $X_1$, where $X_1$ is a coordinate of a point of reflection for a ray 52', which has a maximum divergency angle $$\frac{\alpha'_{\max}}{2}.$$

Curved conical surface 26 must be calculated in correlation with the design of the quasi-toroidal light transforming collector, and depending on the desired luminous intensity distribution I' (X). Those skilled in art will understand that for the preferred embodiment the mutual designs of both the quasi-toroidal light transforming collector and the curved conical collimating combiner will be such that the luminous intensity distribution I" (X) will be constant across the outgoing collimated beam for a given light source 22.

What has been illustrated and described herein is a multiple source light beam collimator that is specifically designed to collect light from a plurality of light sources to produce a single collimated beam of light. However, as the multiple source collimator of the present invention has been illustrated and described with reference to several preferred embodiments, it is to be understood that the full scope of the present invention is not to be limited to these embodiments. In particular, and as those skilled in the relevant art can appreciate, functional alternatives will readily become apparent after reviewing this patent specification and enclosed figures. Accordingly, all such functional equivalents, alternatives, and/or modifications are to be considered as forming a part of the present invention insofar as they fall within the spirit and scope of the appended claims.

We claim:

1. A luminaire comprising:

(A) a light transmissive optical element spaced from and disposed about an axis;

(B) a plurality of light sources disposed radially outwardly of the optical element relative to the axis, for producing a corresponding plurality of light beams, wherein each light source directs a corresponding one of the plurality of light beams toward the optical element, wherein the optical element is optically shaped to collect and pass in the direction of the axis the plural light beams received from the plurality of light sources, (C) a light source support structure; and (D) a light reflective surface spaced from the optical element and disposed along the axis, wherein the light reflective surface is optically shaped to redirect along the axis and combine the plurality of light beams passed by the optical element to produce a collimated beam of light from the re-directed plural light beams.

2. The luminaire of claim 1, wherein the optical element is generally toroidal in shape and is formed by rotating a closed curved section about the axis.

3. The luminaire of claim 1, wherein the light reflective surface is generally conical in shape and is formed by rotating a generally triangular section on the axis.

4. The luminaire of claim 1, wherein each one of the plurality of light sources is a light emitting diode.

5. The luminaire of claim 1, wherein the plurality of light sources are equally peripherally spaced radially outwardly of the optical element relative to the axis.

6. A luminaire comprising:

(A) a light transmissive optical element spaced from and disposed about an axis, wherein the optical element is generally quasi-toroidal in shape;

(B) a plurality of light sources disposed radially outwardly of the optical element relative to the axis, for producing a corresponding plurality of light beams, wherein each light source directs a corresponding one of the plurality of light beams toward the optical element, wherein the optical element is optically shaped to collect and transform the plurality of light beams received from the plurality of light sources and to pass them in the direction of the axis;

(C) a light source support structure; and (D) a light reflective surface spaced from the optical element and disposed along the axis, wherein the light reflective surface is generally conical in shape and is formed by rotating on the axis a generally triangular section having a curved hypotenuse, and wherein the light reflective surface is optically shaped to redirect along the axis and combine the plurality of light beams passed by the optical element to produce a collimated beam of light from the re-directed plural light beams.

7. The luminaire of claim 6, wherein the plurality of light sources are equally peripherally spaced radially outwardly of the optical element relative to the axis.

8. The luminaire of claim 7, wherein each one of the plurality of light sources is a light emitting diode.

9. The luminaire of claim 7, wherein each one of the plurality of light sources is a combination of red, green and blue light emitting diodes with controlled intensity.

10. A luminaire comprising:

(A) a light transmissive optical element spaced from and disposed about an axis, wherein the optical element is substantially quasi-toroidal in shape and is formed by rotating a closed curved section about the axis;

(B) a plurality of light sources disposed radially outwardly of the optical element relative to the axis, for producing a corresponding plurality of light beams, wherein each light source directs a corresponding one of the plurality of light beams toward the optical element, wherein the optical element is optically shaped to collect and transform the plurality of light beams received from the plurality of light sources and pass them in the direction of the axis, wherein the plurality of light sources are equally peripherally spaced radially outwardly of the optical element relative to the axis, and wherein each one of the plurality of light sources is a light emitting diode;

(C) a light source support structure further comprising an effective amount of a heat-transfer surface, disposed in a heat-transfer relationship with the plurality of light sources, to provide for removal of heat that is generated by the plurality of light sources, and (D) a light reflective surface spaced from the optical element and disposed along the axis, wherein the light reflective surface is generally conical in shape and is formed by rotating about the axis a generally triangular section having a curved hypotenuse, and wherein the light reflective surface is optically shaped to redirect along the axis and combine the plurality of light beams passed by the optical element to produce a single collimated beam of light from the re-directed plurality of light beams.

11. The luminaire of claim 10, wherein the quasi-toroidal optical element comprises an assembly of concentric quasi-toroidal components each having different indices of refraction to redirect the plurality of light beams perpendicular to said axis.

12. The luminaire of claim 10, wherein the light source support structure further comprises a temperature-control device disposed within a support structure cavity in association with a heat-transfer surface so that the light emitting diodes operate across a wide temperature range and within one of the following specified performance parameters: luminous output, color, and spatial luminous intensity distribution.

13. The luminaire of claim 10, wherein the light transmissive optical element and the light reflective surface are mutually designed and calculated to provide equal luminous intensity distribution across the single collimated beam of light.

* * * * *